United States Patent [19]

Ehrhardt et al.

[11] 4,343,494

[45] Aug. 10, 1982

[54] CARBONLESS COPY PAPER SYSTEM

[75] Inventors: Gerry H. Ehrhardt, W. Des Moines; Gene D. Carlson, Ankeny, both of Iowa

[73] Assignee: Frye Copysystems, Inc., Des Moines, Iowa

[21] Appl. No.: 208,826

[22] Filed: Nov. 21, 1980

Related U.S. Application Data

[63] Continuation-in-part of Ser. No. 159,587, Jun. 16, 1980, and Ser. No. 160,724, Jun. 18, 1980, said Ser. No. 160,724, is a continuation-in-part of Ser. No. 34,030, Apr. 27, 1979, abandoned, and Ser. No. 34,130, Apr. 27, 1979, abandoned, and Ser. No. 34,131, Apr. 27, 1979, abandoned.

[51] Int. Cl.[3] ..... B41M 5/16; B41M 5/22

[52] U.S. Cl. ..... 282/27.5; 427/150; 427/152; 428/320.2; 428/320.4; 428/320.8; 428/321.1; 428/484; 428/488; 428/537; 428/914

[58] Field of Search ..... 106/14.5, 21, 31, 270, 106/271, 272; 282/27.5; 427/144, 150–153, 261, 288, 398; 428/307, 323, 411, 484, 486, 488, 537, 913, 914, 320.2, 320.4, 320.6, 320.8, 321.1, 321.3

[56] References Cited

U.S. PATENT DOCUMENTS

| | | | |
|---|---|---|---|
| 2,890,124 | 6/1959 | Mange | 106/23 |
| 2,890,125 | 6/1959 | Mange | 106/23 |
| 3,163,548 | 12/1964 | Stark | 106/23 |
| 3,672,935 | 6/1972 | Miller et al. | 282/27.5 |
| 3,894,168 | 7/1975 | Brockett et al. | 428/537 |
| 3,941,608 | 2/1976 | Ehrhardt et al. | 106/32 |
| 3,995,088 | 11/1976 | Garner et al. | 282/27.5 |
| 4,063,754 | 12/1977 | Shackle et al. | 282/27.5 |
| 4,096,314 | 6/1978 | Cespon | 428/307 |
| 4,097,619 | 6/1978 | Davis et al. | 282/27.5 |
| 4,112,138 | 9/1978 | Davis et al. | 282/27.5 |
| 4,226,442 | 10/1980 | Carlson et al. | 282/27.5 |
| 4,238,130 | 12/1980 | Burri | 282/27.5 |

FOREIGN PATENT DOCUMENTS

| | | | |
|---|---|---|---|
| 993656 | 1/1976 | Canada | 282/27.5 |
| 2556083 | 9/1976 | Fed. Rep. of Germany | 282/27.5 |

OTHER PUBLICATIONS

Sherwin Williams, Technical Bulletin AB-47.

*Primary Examiner*—Bruce H. Hess
*Attorney, Agent, or Firm*—Nims, Howes, Collison & Isner

[57] ABSTRACT

An improved chemical carbonless copy paper system including an improved hot melt type of coating for one surface of pressure sensitive carbonless copy paper having discrete liquid droplets of metallic salt solution electron accepting chromogenic reagent material contained therein in operative association with an image receptor coating for the other surface of said paper employing tri (p-phenylamino) phenyl methanol as a dye precursor type chromogenic reagent material therein.

15 Claims, 3 Drawing Figures

CARBONLESS COPY PAPER SYSTEM

Figure 1:
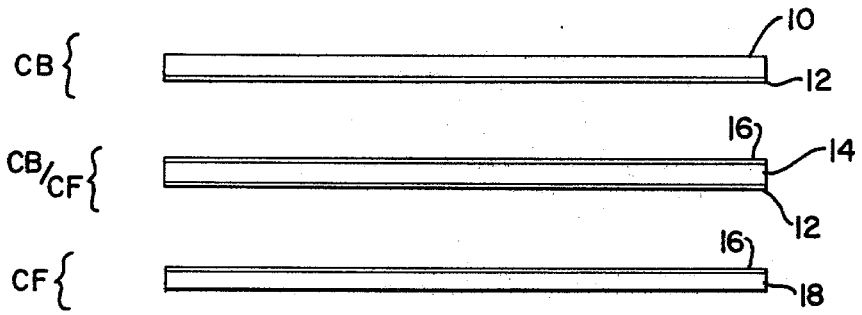
Figure 2A:
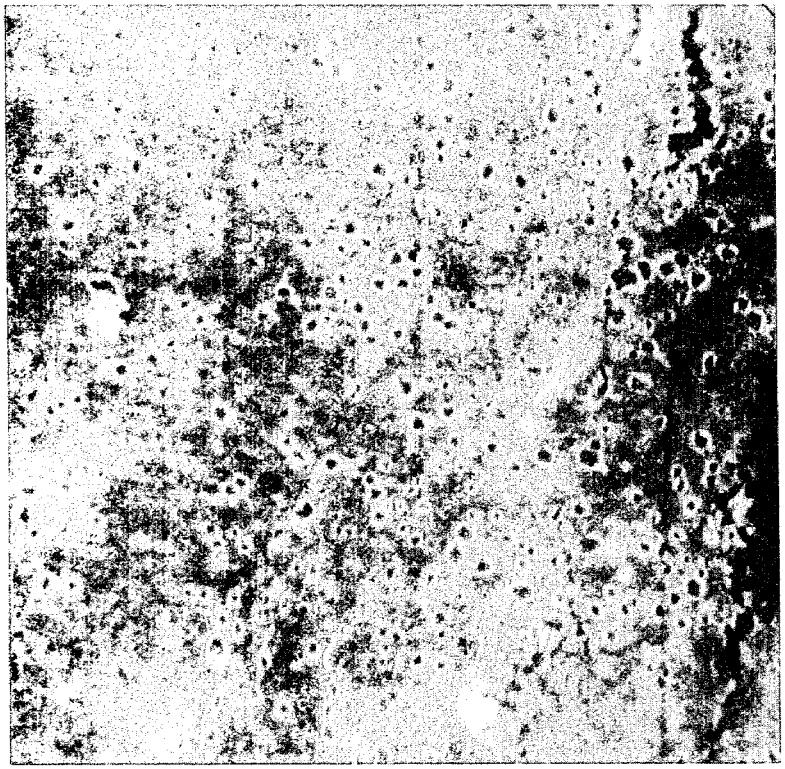
Figure 2B:
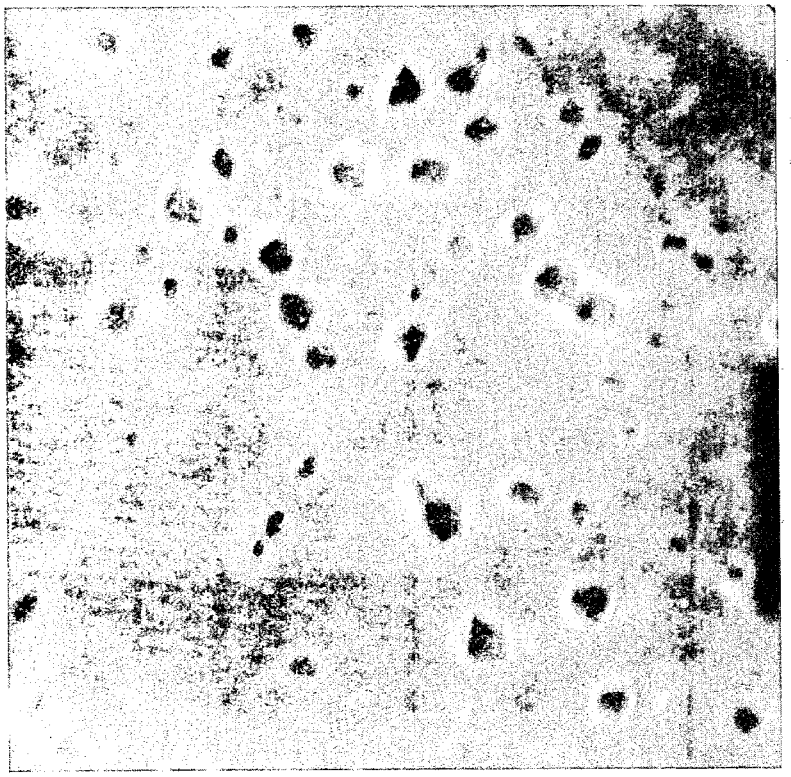

This application is a continuation in part of pending applications Ser. Nos. 06/159,587 and 06/160,724 filed June 16, 1980 and June 18, 1980 respectively and wherein said application Ser. No. 06/160,724 is a continuation in part of applications Ser. Nos. 34,030, 34,130 and 34,131 all filed Apr. 27, 1979 and now abandoned.

This invention relates to pressure sensitive information transfer and duplicating systems and particularly to improved chemical type transfer and reproduction media for effecting duplicative image transfer on sheet material in response to selectively applied pressure and to processes for forming the same.

Pressure sensitive image transfer media of diverse character are widely employed in the information recording and duplication arts. Chemical type or so-called "carbonless" pressure sensitive transfer and duplicating systems, wherein a visable image is formed by the selective chemical reaction of two essentially colorless reagents, have been long recognized as a viable expedient for the formation of duplicate copy material. Such systems normally broadly comprise a substrate supported coating that contains a first normally inactive chemical reagent material that is selectively transferable in response to applied pressure into a reaction providing and color producing relationship with a second normally inactive chemical reagent material contained within or comprising a second coating disposed on the surface of interfacially contiguous second substrate. Conventionally illustrative of such chemical type reproduction systems are transfer and duplicating systems wherein the rear surface on one paper sheet substrate is provided with a coating and which sheet is then termed a "CB" (i.e. coated back) sheet and the front side of that same and/or a separate paper sheet substrate is provided with a coating which is then termed a "CFB" (i.e. coated front and back) or "CF" (i.e. coated front) sheet, respectively. When the coatings on a CB and a CF sheet are placed in interfacially contiguous relation and subjected to selectively applied pressure, as by the pressure of a stylus or the impact of a typewriter key on the obverse surface of the CB sheet, the operative and usually colorless chemical reagents in such coatings are brought into co-reactive relationship, as for example on the surface of the CF sheet, to produce a colored image conforming to the contour of the selectively applied pressure member.

Such chemical type pressure sensitive transfer and duplicating systems are in widespread and expanding use at the present time for the making of multiple copies of selectively recordable duplicative information of sheet material, such as paper and the like due, at least in part, to their basic cleanliness and to the fact that the color producing reagents are inactive until placed into operative co-reactive relationship in response to selective application of pressure.

Although it was early recognized, as for example in the Gill U.S. Pat. No. 1,781,902, that many colorless chemical reagnts were capable of producing a visable colored image upon interreaction therebetween, most of the systems in wide commercial usage at the present time employ a colorless organic dyestuff as a dye precursor in encapsulated liquid form distributed within the CB sheet coating and an electron accepting material in the CF sheet coating. When such CB and CF sheet coatings are placed in contiguous interfacial relation, the application of pressure effects a rupture of the liquid dyestuff confining capsular elements in the area of applied pressure to effect a release of the dye precursor material and selective transfer of at least a portion thereof into co-reacting and color producing relationship with the electron accepting material in the contiguous coating on the CF sheet with the resulting formation of a duplication image thereon.

Some early and relatively recent patents that illustratively disclose chemical type or so-called "carbonless" transfer media employing encapsulated dye precursor materials as the chromogenic reagent in the CB coating and electron accepting materials as the chromogenic reagent in the CF coating are U.S. Pat. No. 2,712,507 (1955) to Green; U.S. Pat. No. 2,730,456 (1956) to Green et al.; and U.S. Pat. No. 3,455,721 (1969) to Phillips et al.

Other more recent patents that illustratively disclose the disposition of the dye precursor material in the CF coating and encapsulated electron accepting material in the CB coating include U.S. Pat. No. 3,787,325 (1974) to Hoover and U.S. Pat. No. 3,984,168 (1975) to Brockett et al.

Such "carbonless" transfer media as presently commercially employed and particularly those that conventionally employ an encapsulated type vehicle for one of the reactive constituents, most usually an organic dyestuff, are not without disadvantage. Among the recognized disadvantage of such media are the fact that they are not only relatively expensive, requiring specialized fabricating techniques, but are also unduly pressure sensitive. Such undue sensitivity often results in undesired premature transfer occasioned by inadvertent dye preursor release and transfer resulting from pressures normally attendant packaging, handling and processing operations, spot coating delineation, printing operations and the like, particularly where multicopy manifolding operations are involved. In addition, such media are inherently subject to a progressively increasing lack of copy definition as the number of desired copies increases as well as by a fading of the copied image with time.

The recently issued Shackle and Young U.S. Pat. No. 4,063,754 discloses and the utilization of non-aqueous "hot melt" coating compositions for CF sheets in a carbonless transfer system incorporating acid reacting color developing reagent materials. Such patent describes, at considerable length, numerous disadvantages attendant employing solvent or water based compositions for effecting the deposition of such carbonless coatings on substrates. Among such enumerated disadvantages are the health and fire hazards attendant the release of generally volatile solvent vapors and the expenditure of significant amounts of energy for the evaporation of the water from aqueous solvent systems. In addition, the practical necessities of solvent recovery and the drying of aqueous coating compositions requires relatively complex and expensive apparatus as well as the attendant problem of solvent safety hazards and disposal of polluted water attendant preparation and clean-up of such aqueous coating compositions.

A further recently issued patent to Shackle and Young's assignee, i.e. U.S. Pat. No. 4,112,138, Davis and Shackle for Manifold Carbonless Form and Process for the Production Thereof discloses the utilization of non-aqueous, solvent free "hot melt" coating compositions for CB sheets. The specific of this patent similarly describes, at considerable length, the numerous disadvantages attendant employing solvent or water based compositions for effecting the deposition of carbonless coatings on substrates.

The Shackle and Young patent and the Davis and Shackle patent stress the "non-aqueous" and "solvent free" character of the assertedly novel hot melt coating compositions, apparently based upon the asserted disadvantages flowing from the presence of water both in the fabrication process and in the finished product. The Davis and Shackle patent discloses the preferred use of microcapsular chromogenic reagent materials in the CB coating although the process claims are not expressely limited thereto. Although the Shackle and Young patent is expressely directed to a hot melt GF coating, the vehicular form of the acidic electron accepting type of color developer, i.e. whether microencapsulated, capsulated, dispersed or other form, is not particularly specified. It is relatively clear, however, that the described CF product is intended for use with CB sheets incorporating an organic dyestuff dye precursor in encapsulated form and, as such, represents an asserted improvement for the capsular type systems presently in widespread commercial use.

The present day widespread commercial employment of CB sheets incorporating encapsulated organic dyestuff dye precursor materials, is, as mentioned above, not without disadvantage, such as undue expense, premature activation, limited reproduction fidelity in multiple copies and detrimental fading of the reproducing images. Such disadvantages have been largely tolerated because of the absence of a viable commercially acceptable alternative. As pointed out above, it was early recognized that many chemical reagents were capable of producing visable duplicative images in chemical transfer paper usage. The aforementioned Gill U.S. patent, for example, employed a member of the gallo-tannic acid series as the chromogenic reagent in the CB sheet coating in association with a ferrous or ferric salt as the chromogenic reagent in the CF sheet coating. In contradistinction to the later Shackle and Young and Davis and Shackle's disclosures, this system requires the presence of solvent at or in the CF sheet coating for the color producing reaction to go forward and hence Gill teaches the inclusion of "a small percentage of glycerine or other non-drying substance, or a hygroscopic ingredient" in the CF sheet coating. The need for the presence of moisture and the deleterious effects of such moisture on the paper substrate was early recognized in the Gookin et al. U.S. Pat. No. 1,950,982, who provided a water impervious film intermediate the substrate and the CB and CF sheet coatings and included in the latter both magnesium chloride as chromogenic reagent material and glue or gelatine as moisture retaining material. A somewhat different approach was followed in Groak U.S. Pat. No. 2,168,098, who disclosed a CB sheet coating composed of a hard waxy substance having dispersed therein an admixture of starch, a hydroscopic material, such as glycerine, and a color producing reactive substance. In neither of these approaches, however, was water included as a necessary ingredient in the coating composition and thus basically conformed in such disclosure and teaching to the later issued Shackle patents.

Some of the aspects of the approach that was early suggested by the Gill, Gookin and Groak patents have recently reappeared in Austrian Pat. No. 331,825 which issued March 25, 1976 (and apparent counterpart Canadian Patent No. 993,656 and West German publication No. 2,342,596 of Apr. 11, 1974). In these disclosures, an organic dyestuff dye precursor is dispersed in a binder on the CF sheet and used in conjunction with an essentially fully transferable CB sheet coating which incorporates clay materials as the electron accepting chromogenic reagent material, either alone or in association with phenolic material and inorganic salts of multivalent metals. Solvent, water based and hot melt systems are specifically disclosed for the CB sheet coatings. Significantly, however the hot melt CB sheet coatings are all water free, again in conformity with the Shackle teachings.

A later issued West German patent application No. 24 56 083.2 of Sept. 2, 1976 (based on Austrian application No. A1405/75 of Feb. 25, 1974 and its apparent counterpart abandoned U.S. application Ser. No. 655,019 of Feb. 4, 1976 as referenced in U.S. Pat. No. 4,096,314) discloses the utilization of metal chlorides, preferably in combination with urea or urea derivatives, as CF sheet coatings in both solvent and aqueous systems. In association therewith, there is disclosed the utilization of organic dyestuff dye precursors dispersed in a hot melt coating medium as the CB coating. The preferred CF sheet coatings are identified as those, for a water based coating, that contain zinc chloride and urea and further include a metal stearate.

While considerable effort has also been directed over the past years to the improvement of encapsulation techniques and to the provision of improved CB type coatings, a further problem faced in this art is the ever increasing expense of conventionally employed dye precursor materials such as crystal violet lactone and the like and the degradable sensitivity thereof to both light and water. These latter pose continuing and as yet unsolved problems in the search for improved and lower cost chemical carbonless transfer systems.

This invention may be briefly described, in its broad aspects, as an improved chemical type transfer and duplicating system comprising a hot melt type of CB sheet coating containing and retaining discrete and selectively constituted liquid electron accepting chromogenic reagent material and to methods for forming the same. In its narrower aspects, the subject invention includes a novel hot melt CB coating constituted of an intermixture of natural and synthetic waxes containing and retaining discrete microscopic droplets of a selectively constituted solution of a metallic chloride, preferably zinc chloride in water suitably buffered to minimize, if not effectively neutralize, the available acidic chloride content thereof uniformly distributed therewith as a color producing reagent. In operative association therewith the invention includes a compatible and improved solvent system type CF sheet coating employing tri (p-phenylamino) phenyl methanol as to a dye precursor type chromogenic reagent material selectively dispersed throughout an alkaline biased carrier film.

Among the manifold advantages attendant the practice of the subject invention is the provision of improved low cost carbonless transfer media that serve to provide markedly increased numbers of duplicative copies with sharper, more intense and highly smear resistant transferred images. Additional advantages include compatability with "one time" carbon papers and standard printing inks; a permitted reduction in basis weights and the provision of an odorless CB sheet coating that can be reused one or more times, thus permitting retyping on the obverse surface thereof. Other advantages include the provision of a CB sheet coating that can be readily striped and spot coated and which is recyclable. Still other advantages include the provision of a CB sheet coating that can be fabricated with minimal energy requirements on conventional coating equipment requiring minimal capital investment. Additional advantages attendant the practice of the subject invention include the permitted use of a broadly acid responsive, inexpensive and readily available pigment type product as a dye precursor; the provision of an image receptor coating that is effectively water and light stable and, absent interreaction with available acidic material, is highly resistant to premature actuation normally from extreme climatic conditions. Further advantages of the disclosed combination of coatings include the provision of transferred images that are effectively stable in character and a system which is operable at temperatures as low as −30° F. Still further advantages include the provision of transfer and image receptor coatings of extended shelf life that are markedly resistant to undesired premature activation under conditions of high temperature and/or high humidity; that are characterized by reduced potential to irritate sensitive skins and to corrode iron rollers and other components of coating, printing and collating apparatus; coatings that are essentially uncritical as to substrate character and which are highly resistant to undesired transfer on printing presses, collators and other equipment normally incident to manifolding, printing and packaging operations.

The principal object of this invention is the provision of improved chemical type pressure sensitive transfer and reproduction system and to processes for fabricating the same.

A further principal object of this invention is the provision of an improved hot melt chromogenic reagent containing coating composition for CB transfer sheets in association with an inexpensive, light and water stable dye precursor containing image receptor coating for chemical carbonless copy systems.

Another object of this invention is the provision of an improved composite wax base hot melt type of CB sheet coating containing discrete droplets of a selectively constituted water solution of a zinc chloride suitably buffered to minimize, if not effectively neutralize, the available acidic chloride content thereof uniformly distributed therewithin as a color producing reagent in association with an image receptor coating that employs tri (p-phenylamino) phenyl methanol as a dye precursor type chromogenic reagent material therein.

A further object of this invention is the provision of a water base zinc chloride solution for use as electron accepting chromogenic reagent material in carbonless transfer systems that is effectively non-corrosive and non-irritating and which is highly resistive, when dispersed in a hot melt carrier vehicle, to undesired premature image actuation under conditions of high temperature and/or high humidity in association with a light and water stable receptor coating that employs tri (p-phenylamino) phenyl methanol dispersed throughout an alkaline biased carrier film as the chromogenic reagent therein.

Other objects and advantages of the subject invention will become apparent from the following portions of this specification which describe, in accord with the mandate of the patent statutes, the principles of the invention and best mode presently contemplated by the inventors for carrying out said inventions.

FIG. 1 is a schematic representation of chemical type pressure sensitive transfer and reproduction media incorporating the principles of this invention; and FIGS. *2a* and *2b* are photomicrographs (4200X and 14000X) of an improved hot melt CB coating formed and constituted in accordance with the principles of this invention.

Referring to the drawings and initially to FIG. 1, there is provided an illustrative set of chemical type of carbonless transfer and reproduction media fabricated in accord with the principles of the invention. As there shown, such set includes a CB sheet comprising a first planar substrate 10, suitably a paper sheet or web, having a thin solidified hot melt CB coating 12, constituted as hereinafter described, disposed on the undersurface thereof. Adapted to be positioned in interfacially contiguous relation with the CB coating 12 on the underside of substrate 10 is a CF sheet coating 16 disposed on the upper surface of a second paper sheet substrate 14. Such substrate 14 may have its undersurface coated with a CB coating 12 and thus constitute a CFB sheet, or may have an uncoated undersurface and thus constitute a CF sheet. Alternatively, and illustratively adapted to be disposed in interfacially contiguous relation with either a CB coating 12 on the underside of the "CFB" sheet 14 or with a CB coating 12 on the underside of the "CB" sheet 10, is a separately illustrated "CF" sheet having a CF coating 16 disposed on the upper surface of a third substrate 18. As will be apparent to those skilled in the art, any number of intermediate CFB sheets or webs 14 may be interposed in stacked relation to form a multilamina transfer and reproduction system. Likewise, such multilamina set may include one time carbon transfer sheets interposed with uncoated or CB coated sheets or webs in a manifold arrangement in accord with the dictates of the user thereof.

The novel and improved hot melt CB sheet coating broadly comprises the resulting set or solidified film from an applied and subsequently cooled emulsified liquid intermixture of a melted low oil content wax carrier vehicle, preferably of composite character, a melted synthetic flow was and dispersant and a chromogenic reagent solution of zinc chloride dissolved in water and suitably buffered to minimize, if not effectively neutralize the available acidic chloride content thereof; said emulsified intermixture also desirably having uniformly dispersed therein small but critically limited amounts of a resinous film forming agent to promote film hardness and toughness, an isolating Agent to minimize, if not effectively preclude, undesired transfer of the coating or portions thereof in response to unintentional pressure application and an opacifier-filler to reduce the gloss of the finished copy and preserve the appearance of the substrate.

In its narrower aspects, the subject invention includes a hot melt CB sheet coating composition formed of about 35 to 75 percent of a meltable low oil content synthetic or naturally derived hard wax vehicle; at least 1 to about 15 percent of a chemically modified wax-like material having properties of a flow agent, dispersant and emulsifier; and at least 10 to about 35 percent of a chromogenic reagent component in the form of a Lewis acid, desirably zinc chloride dissolved in an appropriate amount of water necessary to form a relatively concentrated solution thereof.

Optionally but desirably included in such CB sheet coating composition for provision of an enhanced commercially attractive product are one or more of the following additional constituents. One such optional constituent comprises a film forming agent to encourage the formation of a harder and tougher surface film after setting and to thus minimize premature actuation of the color producing reaction. This film forming agent must be non-reactive with the chromogenic reagent and may vary in amount from a minimum of about 2% up to an amount that deleteriously effects the flow characteristics of the mix. Another such optional but yet desirable constituent comprises an isolating agent that is essentially incompatible with the wax vehicle when solidified and which serves to provide desriable surface characteristics to the resultant film, such as to minimize, if not effectively preclude, undesired transfer of the coating or portions thereof in response to unintentional pressure application. The isolating agent may vary in amount from a desirable minimum of about 2% up to a maximum of about 20%. A still further optional but desirable constituent is an opacifier-filler to enhance the appearance of the coated surface of the CB sheet, such as by reducing the gloss thereof. As is well known in this art, such opacifier-filler may vary in amount required to provide a desired appearance, typically about 5%, and many include titanium dioxide, various non-acidic high brightness clays, lithopone or other recognized materials.

The meltable wax vehicle may suitably comprise any of the low oil content paraffin waxes, microcrystalline waxes, carnauba, Montan or other conventionally employed low oil content vegetable, synthetic or mineral derived hot melt wax type carrier vehicles. The presently preferred meltable wax vehicle is a composite made up of about 3 to 4 parts of a low oil content paraffin wax, intermixed with about 1 part or less of carnauba wax. A presently preferred paraffin wax is a low oil content, high melting point, fully refined paraffin wax, suitably Pacemaker 53 as manufactured and sold by Cities Service Oil Co. of Tulsa, Okla. Such wax has the following properties:

| | |
|---|---|
| Melting point, ASTM, °F. | 143–150 |
| Melting point, AMP | 146–153 |
| Oil Content, Wt. % max | 0.25 |
| Odorless | |
| Viscosity, cs at 210° F. | 5.5 |
| Needle penetration at 77° F. | 13 |
| Flash point °F. | 485 |

Other suitable low oil content hot melt wax carrier vehicles include alpha olefinic waxes, suitably #6817 Synthetic Wax as available from Moore & Munger Inc. of Fairfield, Conn.; microcrystalline wax, suitably 195 Be Square White, available from Petrolite Corporations Bareco Division or carnauba wax, suitably Brazilian Refined available from Baldini & Company of Milburn, N.J.

Moore & Munger's #6817 Synthetic Wax has the following properties:

| | |
|---|---|
| Congealing Point, °F. ASTM D 938 | 162 |
| Needle penetration, mm/10, ASTM D 1321 77° F. | 14 |
| Viscosity, Saybolt (a) 210° F. (SUS), ASTM D 2161 | 52 |
| Viscosity, Kinematic (a) 210° F. (Cs.). ASTM D 445 | 8 |
| Color, Saybolt, ASTM D 156 | +4 |

-continued

| | |
|---|---|
| Flash Point, °F. (COC) | 510 |

Bareco's 195 Be Square White microcrystalline wax has the following properties:

| | |
|---|---|
| Melting Point, °F. ASTM D 127 | 193/198 |
| Penetration (a) 77° F. ASTM | 6/7 |
| Color ASTM D 1500 | 0.5/0.5+ |

A preferred carnauba wax is Baldini's Brazilian Refined Carnauba wax that is possessed of the following properties:

| | |
|---|---|
| Melting point, min., °F. | 180.5 |
| Acid Number | |
| minimum | 4.0 |
| maximum | 10.0 |
| Saponification Number | |
| minimum | 78.0 |
| maximum | 88.0 |

The meltable chemically modified wax-like material having the desired properties of a flow agent, dispersant and emulsifier most suitably comprises a material of the type disclosed in U.S. Pat. No. 3,941,608. Other suitably chemically modified wax materials having the somewhat similar properties include modified synthetic waxes as disclosed in U.S. Pat. Nos. 2,890,124, 2,890,125 and 3,163,548. A preferred commercially available wax-like material formulated in accord with U.S. Pat. No. 3,941,608 is #7315 wax as sold by Moore & Munger, Inc., of Fairfield, Conn. Such #7315 wax has the following general properties:

| | |
|---|---|
| Penetration Hardness (FLP)I-22 | 5 Typical |
| Melting Point (Fisher Johns) | 144° Typical |
| Acid Number (ASTM D 974) | 2 Typical |

Another suitable wax-like material having somewhat similar properties as the foregoing suitably comprises an amide of a fatty acid, such as Armid HT as available from Armour Industrial Chemical Company. Such Armid HT is possessed of the following properties:

| | |
|---|---|
| Amide % (min.) | 90 |
| Iodine value | |
| minimum | — |
| maximum | 5 |
| Free fatty acid % | |
| minimum | — |
| maximum | 5 |
| Melting Point, °C. | |
| minimum | 98 |
| maximum | 103 |

The resinous film forming agent serves to enhance the formation of a relatively hard and tough coating to minimize undesired transfer of reagent material across the CB/CF interface in the absence of intentional positive pressure application. A suitable film forming agent, which must be non-reactive with chromogenic reagent component, desirably comprises a relatively low melting point ehtylene-vinyl acetate copolymer, such as AC-400, as manufactured and sold by Allied Chemical Corporation. Such resinous film forming agent has the following properties:

| | |
|---|---|
| Softening Point (ASTM E-28) | 204°F. |
| Hardness dmm (ASTM D-5) | 9.5 |
| Density 8/cc (ASTM D-1505) | 0.92 |
| Viscosity (284° F. - Brookfield) | 550 |

Another suitable film forming agent comprises oxidized polyethylene, suitably AC-629 as manufactured and sold by Allied Chemical Company. Such film forming agent has the following properties:

| | |
|---|---|
| Softening Point | 214° F. |
| Hardness | 5.5 |
| Density g/cc | 0.93 |
| Average Viscosity CPS 284° F. | 160 |
| Acid Number | 15 |

The isolating agent cooperatively functions as blooming agent to provide a lubricating and barrier surface to the solidified coating. Such isolating agent, which should be essentially incompatible with the wax carrier vehicle when solidified, so as to be selectively effective at the exposed surface, suitably comprises a small amount of stearic acid, desirably HYSTRENE 9718 as manufactured and sold by the Humko Chemical Company. Zinc stearate may also be employed.

The opacifier-filler, which cosmetically serves both to reduce the gloss of the finished coating and to preserve the appearance of the substrate, suitably comprises finely divided titanium dioxide such as UNITANE 0-110 as manufactured and sold by American Cyanamid Company. This material has a specific gravity of about 3.9 and is so finely divided as to leave only about a 0.10% residue on a 325 mesh screen.

The chromogenic reagent component comprises a concentrated water base solution of zinc chloride, suitably buffered to minimize, if not effectively neutralize, the available acidic chloride content thereof. Such solution is preferably made up of about 2 to 4 parts of zinc chloride with about 1 part of water and which approaches a saturated solution.

While unbuffered solutions of zinc chloride as the chromogenic reagent have provided highly effective image formation in transfer coatings as formulated in accord with the foregoing disclosed formulations, such have been subject, under extreme climatic conditions of high temperature and/or high humidity, to the apparent generation and emanation of hydrogen chloride. Although the quantities of hydrogen chloride so generated, appear to be minimal, even under such extreme climatic conditions, the apparent emanation thereof from the applied coating has resulted in varying degrees of premature actuation of dye precursors over the entire surface of an interfacially contiguous CF coating and, depending on the ambient climatic conditions, in varying degrees of actuation of such CF sheet. Such premature actuation is, of course, highly undesirable as is the generation of hydrogen chloride with its potential to irritate sensitive skins and to corrode iron rollers and other components of the processing equipment under any set of climatic conditions.

In order to neutralize, if not actually prevent, the generation and emanation of such hydrogen chloride, a small amount of a neutralizing ammonium salt, suitably ammonium carbonate or ammonium bicarbonate, is dissolved in the zinc chloride solution. For a concentrated solution of about 2 parts of zinc chloride to 1 part of water, about 0.1 part of such neutralizing ammonium salt is generally satisfactory. Experience to date has generally indicated that the addition of about 2 to 4% of ammonium carbonate to zinc chloride solutions of the type herein disclosed results in effective avoidance of the above problems in an improved product.

While the mechanics of the reaction process are not fully understood it is surmised that the ammonium salt operates to neutralize or otherwise reduce the available active or acid chloride ion content and to thus preclude its association with available hydrogen ions. Also the possible availability of ammonia in both the liquid and gaseous phase may also contribute to the neutralization of hydrogen chloride in both such phases.

Apart from the foregoing, the additions of such neutralizing ammonium salt has provided some totally unexpected and, as yet, unexplainable advantages and results. Such unexpected results are a bleaching and a marked increase in the hardness of the solidified CB hot melt coating. Such increase in hardness not only functions to minimize pick off on processing components, reduces the tendency to smear and provides sharper copy, but also permits of significant reduction in the quantity of carnauba wax that is otherwise desirably included therein. Carnauba wax is not only one of the more cost significant components of the coating but is also only obtainable from a foreign source of supply who controls the ever increasing price thereof.

The unexpected bleaching action also enhances the appearance of the product through an enhancement of the "whiteness" of the coating.

A presently preferred hot melt CB sheet coating broadly comprises the resulting set or solidified film from an applied and subsequently cooled emulsified liquid intermixture of about 50–60% of a melted low oil content composite wax carrier vehicle, made up of about 3 to 4 parts of a low oil content paraffin wax intermixed with about 1 part of carnauba wax; about 2 to 5% of a chemically modified synthetic flow wax and dispersant and about 25–35% of a chromogenic reagent solution of at least 2 parts of zinc chloride dissolved in about 1 part of water buffered by a small amount of ammonium carbonate as outlined above; said emulsified intermixture also desirably having uniformly dispersed therein about 3 to 10% of a resinous film forming agent to promote film hardness and toughness, about 3–10% of an isolating agent to minimize, if not effectively preclude, undesired transfer of the coating or portions thereof in response to unintentional pressure application and about 5% of an opacifier-filler to reduce the gloss of the finished copy and preserve the appearance of the substrate.

In the production of the above described preferred CB sheet coating composition in accord with the principles of this invention, the requisite amounts of zinc chloride and water are intermixed in a reaction vessel, suitably a steam jacketed kettle having a 210° F. temperature setting, to form a hot concentrated solution thereof. To such solution is then added the neutralizing ammonium salt, preferably ammonium carbonate. To such elevated temperature and now neutralized chromogenic reagent solution, the requisite amounts of melted low oil content paraffin wax and carnauba wax components of the composite wax carrier vehicle are added and thoroughly intermixed as by use of a high speed dispersing blade for about 10 minutes or longer. To the intermixture as so constituted, the flow wax and dispersant constituent and the polyethylene filming agent and stearic acid isolating agent constituents are added in solid form with continual mixing until such constituents are completely melted and dissolved in the composite wax carrier vehicle. When so melted and dissolved and the opacifier-filler, preferably titanium dioxide is added and the entire mass thoroughly mixed at high speed for 30 to 40 minutes to form a selectively constituted liquid hot melt emulsion.

The resulting liquid hot melt emulsion is readily and selectively applied in the form of a thin film, as for example at a coating weight of as low as 2 grams/square meter, by conventional means to the surface of a substrate, such as a sheet or web of paper or resinuous film. The conventional coating means may comprise a print type coater, a roll coater or the like. The so coated substrate is then passed over a chill roll or the like to rapidly solidify or set the applied emulsified coating composition.

In contradistinction to the systems of the prior art which were operatively dependent upon an external water source (often humid air) to provide the necessary ionized zinc chloride to react with the dye precursor, the system of the present invention contains and retains water as an operative element in discrete droplet liquid form within the solidified CB film and thus effects the selective transfer of ionized zinc chloride as the operative entity.

Photomicrographs of coatings formulated in accord with the principles of this invention are shown in FIGS. *2a* and *2b* at magnifications of 4200X and 14000X respectively. These photomicrographs clearly depict the presence of discrete, microscopically sized zinc chloride ammonium salt solution globules distributed throughout the coating. Most of such globules are less than 1 micron in diameter with the great majority thereof falling between 0.25 and 0.75 microns. Such photomicrographs further show that such zinc chloride solution globules peripherally incorporate an interface layer or the like that differs, at least in some physical respects from both the zinc chloride solution globules and from the surrounding solidified wax material as evidenced by the clearly different refractive indices involved.

The above ends, the foregoing described method of formulation provides a selectively constituted emulsion in which zinc chloride solution entities are thoroughly dispersed within the film. The basic hygroscopic, if not actual deliquescent, properties of zinc chloride and the nature of the resultant film serve to minimize, if not effectively prevent, water loss in storage with enhanced operating life for the product.

Another factor which contributes to the retention of the dispersed zinc chloride solution in discrete liquid globular form within the CB film is the enhanced emulsification obtained through the use of an essentially alkaline and amino containing dispersant—flow wax constituent in association with the relatively high acid number wax and film forming components.

By way of further examples the following formulations have provided CB sheet coating having in varying degree, the manifold advantages earlier set forth.

EXAMPLE I

| | % |
|---|---|
| Paraffin Wax | 45.0 |
| 7315 Wax | 2.0 |
| AC-400 Polyethylene | 5.0 |
| Stearic Acid | 3.0 |
| Titanium Dioxide | 5.0 |
| Zinc Chloride | 30.0 |
| Water | 10.0 |

EXAMPLE II

| | |
|---|---|
| Paraffin Wax | 41.0 |
| 7315 Wax | 2.0 |
| AC-629 Polyethylene | 7.0 |
| Titanium Dioxide | 5.0 |
| Zinc Stearate | 10.0 |
| Zinc Chloride | 30.0 |
| Water | 5.0 |

EXAMPLE III

| | % |
|---|---|
| Paraffin Wax | 35.0 |
| AC-400 Polyethylene | 10.0 |
| Zinc Chloride | 20.0 |
| Water | 10.0 |
| 7315 Wax | 10.0 |
| Stearic Acid | 10.0 |
| Titanium Dioxide | 5.0 |

EXAMPLE IV

| | % |
|---|---|
| Paraffin Wax | 55.0 |
| Carnauba Wax | 20.0 |
| Zinc Chloride | 15.0 |
| Water | 5.0 |
| 7315 Wax | 2.0 |
| Stearic Acid | 3.0 |

EXAMPLE V

| | % |
|---|---|
| Paraffin Wax | 10.0 |
| Microcrystalline Wax | 30.0 |
| Stannous Chloride | 30.0 |
| Water | 10.0 |
| 7315 Wax | 3.0 |
| Stearic Acid | 7.0 |
| Titanium Dioxide | 10.0 |

EXAMPLE VI

| | % |
|---|---|
| Carnauba Wax | 10.0 |
| Alpha Olefin Wax | 40.0 |
| AC-629 Polyethylene | 7.0 |
| Ferric Chloride | 20.0 |
| Water | 10.0 |
| 7315 Wax | 3.0 |
| Stearic Acid | 5.0 |

-continued

| | % |
|---|---|
| Titanium Dioxide | 5.0 |

By way of further preferential example, the above formulations, when buffered to minimize, if not effectively neutralize, the available acidic chloride content thereof, are modified as follows:

EXAMPLE IA

| | % |
|---|---|
| Paraffin Wax | 42.0 |
| 7315 Wax | 2.0 |
| AC-400 Polyethylene | 5.0 |
| Stearic Acid | 2.0 |
| Titanium Dioxide | 5.0 |
| Zinc Chloride | 30.0 |
| Ammonium Carbonate | 3.0 |
| Water | 10.0 |

EXAMPLE IIA

| | % |
|---|---|
| Paraffin Wax | 38.0 |
| 7315 Wax | 2.0 |
| AC-629 Polyethylene | 7.0 |
| Titanium Dioxide | 5.0 |
| Zinc Stearate | 10.0 |
| Zinc Chloride | 30.0 |
| Ammonium Bicarbonate | 3.0 |
| Water | 5.0 |

EXAMPLE IIIA

| | % |
|---|---|
| Paraffin Wax | 33.0 |
| AC-400 Polyethylene | 10.0 |
| Zinc Chloride | 20.0 |
| Ammonium Carbonate | 2.0 |
| Water | 10.0 |
| 7315 Wax | 10.0 |
| Stearic Acid | 10.0 |
| Titanium Dioxide | 5.0 |

EXAMPLE IVA

| | % |
|---|---|
| Paraffin Wax | 51.0 |
| Carnauba Wax | 20.0 |
| Zinc Chloride | 15.0 |
| Ammonium Carbonate | 4.0 |
| Water | 5.0 |
| 7315 Wax | 2.0 |
| Stearic Acid | 3.0 |

EXAMPLE VA

| | % |
|---|---|
| Paraffin Wax | 9.0 |
| Microcrystalline Wax | 28.0 |
| Stannous Chloride | 30.0 |
| Ammonium Bicarbonate | 3.0 |

-continued

| | % |
|---|---|
| Water | 10.0 |
| 7315 Wax | 3.0 |
| Stearic Acid | 7.0 |
| Titanium Dioxide | 10.0 |

EXAMPLE VIA

| | |
|---|---|
| Carnauba Wax | 8.0 |
| Alpha Olefin Wax | 38.0 |
| AC-629 Polyethylene | 7.0 |
| Ferric Chloride | 20.0 |
| Ammonium Carbonate | 4.0 |
| Water | 10.0 |
| 7315 Wax | 3.0 |
| Stearic Acid | 5.0 |
| Titanium Dioxide | 5.0 |

The following formulations have provided highly preferred CB sheet coatings:

EXAMPLE VII

| | % |
|---|---|
| Paraffin Wax | 39.0 |
| Carnauba Wax | 14.0 |
| Zinc Chloride | 20.0 |
| Water | 10.0 |
| 7315 Wax | 2.0 |
| AC-400 Polyethylene | 5.0 |
| Stearic Acid | 5.0 |
| Titanium Dioxide | 5.0 |

EXAMPLE VIIA

| | % |
|---|---|
| Paraffin Wax | 36.0 |
| Carnauba Wax | 14.0 |
| Zinc Chloride | 20.0 |
| Water | 10.0 |
| Ammonium Carbonate | 3.0 |
| 7315 Wax | 2.0 |
| AC-400 Polyethylene | 5.0 |
| Stearic Acid | 5.0 |
| Titanium Dioxide | 5.0 |

The improved CF or image receptor coating comprises the solid residue of an applied alkaline biased homogeneous mixture of an evaporable non-polar hydrocarbon solvent, a chemically neutral or alkaline resinous binder, an opacifier-filler and tri (p-phenylamino) phenyl methanol as a dye precursor type of chromogenic reagent material. Such solidified CF coating is further characterized by the presence of such dye precursor in solid form and which dye precursor is insoluble in water or other polar solvents. Optionally by desirably included therein is a dispersant to assist in the uniform dispersion of such dye precursor throughout the mix and a thickener to provide the requisite viscosity properties to facilitate the coating of the mix in accord with the particular requirements of the coating equipment employed.

The evaporable liquid vehicle must be of a non-polar character and a solvent for the tri (p-phenylamino) phenyl methanol dye precursor component. Suitable non-polar organic solvents include acetone, toluene, heptane and naphtha, with toluene being presently preferred for use.

A presently preferred CF coating comprises the solid residue of an applied intermix of an evaporable nonpolar solvent, suitably 50 to 80 parts of toluene, having dissolved therein at least about 7 to 20 parts of a chemically neutral or alkaline resinous binder, suitably polyvinylacetate. Added thereto is about 0.1 to 0.5 parts of a dispersant and about 0.1 to 4 parts of dry potassium hydroxide to provide an alkaline bias to the mix and to minimize inadvertent color reactions in the CF coated sheets. Also included in the mix is about up to 45 parts of opacifier-fillers, suitably up to about 20 parts finely divided titanium dioxide and the remainder of calcium carbonate; and about 0.5 to 5 parts of tri (p-phenylamino) phenyl methanol as the chromogenic reagent.

The nature of the binder is not attended with any particular degree of criticality as long as it is of chemically neutral or of alkaline character and functions as a binding agent for the opacifier-filler and the color precursor, with both of the latter being in solid form. A preferred binder material which is readily soluble in the above described evaporable nonpolar solvent carrier comprises polyvinylacetate, suitably Vinac B-15, as manufactured by Air Products & Chemicals Company.

A presently preferred dispersant comprises sodium salt of polymeric carboxylic acid such as Tamol 731 as manufactured by Rohm & Haas Company of Philadelphia, Pa.

The opacifier-filler, which serves both to enhance the appearance of the coating and to cooperate in the uniform distribution and spaced separation of the solid color precursor in the CF coating must also be of neutral or alkaline character. Such filler may suitably comprise calcium carbonate such as Albaglos as manufactured by Chas. Pfizer & Co. This material has a pH of 9.4, a specific gravity of 2.7 and an average particle size of about 0.75 microns. Another suitable opacifier-filler employed in conjunction with the above is Unitane 0-1110 titanium dioxide as manufactured by the American Cyanamid Company. This material has a minimum $TiO_2$ content of 99%, a pH of about 7.7 and a specific gravity of about 3.9.

As noted above, the chromogenic reagent employed is tri (p-phenylamino) phenyl methanol. Such chromogenic reagent, as disclosed in the Pigment Handbook (Vol. I) published by John Wiley & Sons (Ed. Temple C. Patton; 1973), purportedly has the following chemical structure:

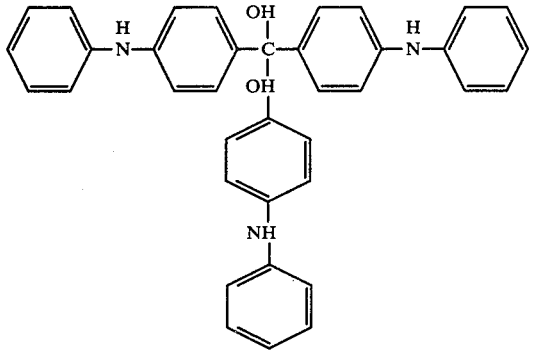

The depicted incorporation of the hydroxyl group intermediate the methane carbon atom and the phenyl group, however, is incorrect and the correct structural formula thereof is

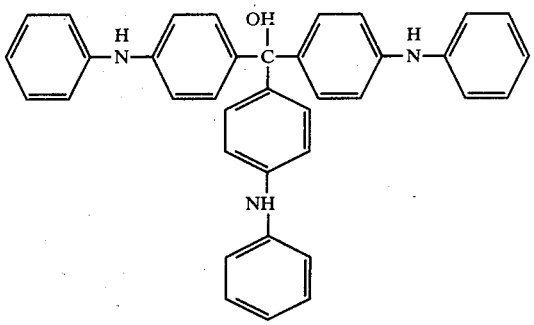

Such text further indicates however that in any commercially available supply thereof, that some lower phenylated product having the following chemical composition is probably also present:

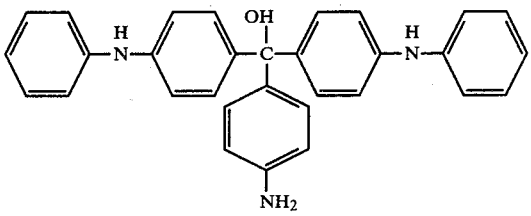

Such material may be described as biphenyl triamino triphenyl methanol.

The disclosed tri (p-phenylamino) phenyl methanol as identified above is obtainable from The Sherwin-Williams Company and from BASF albeit in an apparently somewhat impure or contaminated form. As indicated in Sherwin-Williams technical bulletin AB-47, the tri (p-phenylamino) phenyl methanol (therein called "Spirit Blue Carbinol Form") in the presence of an acid pH and a chloride forms an intensely colored dye stuff known as Solvent Blue 23 (CI No. 42760).

Transposition into or form its colorless form is solely pH responsive, with intense color being produced in an acid pH environment. Alkaline biasing of the coating is maintained by the selective utilization of alkaline biased constituents as set forth above and by the inclusion of small amounts of potassium hydroxide when necessary or desirable.

In the production of the above described receptor coating for CF sheets, a liquid mixture is first formed by intermixing the non-polar toluene solvent with the polyvinylacetate binder material, the dispersant, the potassium hydroxide (to cast the pH of the solution to the alkaline side) with continuous agitation until all solids are completely dissolved after which the organic dyestuff dye precursor material is added with continued stirring until it is dissolved. To the above liquid mixture is then added the requisite amounts of calcium carbonate and the titanium dioxide opacifier-filler. Such addition should be accompanied by continuous stirring of such constituents in the liquid vehicle to obtain a uniform dispersion thereof.

The specified dye precursor can be added as a powder, or it can be added in its acidified colored form. If the latter colored form is so utilized, the requisite alkaline cast of the other constituents, including any necessary amounts of potassium hydroxide, will cause the dye to revert to its colorless form in the mixture.

By way of specific example the following formulation has provided an improved but yet inexpensive CF sheet coating.

EXAMPLE I

| | % |
|---|---|
| Toluene | 53.0 |
| Potassium Hydroxide | 1.0 |
| Calcium Carbonate | 31.8 |
| Tri (p-phenylamino) phenyl methanol | 1.0 |
| Polyvinylacetate | 13.0 |
| Dispersant | 0.2 |

EXAMPLE II

| | % |
|---|---|
| Toluene | 53.0 |
| Potassium Hydroxide | 1.0 |
| Calcium Carbonate | 27.0 |
| Titanium Dioxide | 4.8 |
| Tri (p-phenylamino) phenyl methanol | 1.0 |
| Polyvinylacetate | 13.0 |
| Dispersant | 0.2 |

The foregoing CF coating formulation results in a CF coating layer of neutral or alkaline character, of acceptable appearance and having the color precursor chromogenic reagent homogeneously distributed there throughout. Such coatings are singularly inexpensive, abrasion and odor free and have been formed of coating weights as low as 0.2 grams/square meter. Used with the CB coatings herein disclosed the image forming reaction proceeds without the color precursor chromogenic reagent material in the CF coating being solubilized and ionized by the liquid electron accepting chromogenic reagent material emitted from the CB coating and in a markedly improved chemical carbonless copy paper system.

Having thus described our invention, we claim:

1. A pressure sensitive chemical type transfer medium comprising:

planar sheet material having an at least partially transferable coating layer disposed on one surface thereof constituted by the solidified residue of an applied hot melt low oil content wax base emulsified liquid film including a chemically modified wax-like material having flow agent, dispersant and emulsifying properties and having discrete liquid droplets of a concentrated water base solution of ionized zinc chloride and an acidic halogen neutralizing agent dispersed therein and a non-transferable image producing receptor layer dispoed on the other surface thereof;

said image receptor layer comprising the solid residue of an applied alkaline biased liquid intermixture of an evaporable non-polar liquid hydrocarbon solvent vehicle, a non-acidic resinous binder, opacifier-filler material and a chromogenic reagent selected from the group consisting of tri (p-phenylamino) phenyl methanol and biphenyl triamino triphenyl methanol dispersed therewithin and being selectively convertable into a color producing condition upon interreaction with said zinc chloride chromogenic reagent material.

2. A pressure sensitive chemical type transfer medium as set forth in claim 1 wherein:

said applied hot melt low oil content wax base emulsified liquid film includes an amine modified synthetic wax flow agent and dispersant as an emulsifying agent therewithin.

3. A pressure sensitive chemical type transfer medium as set forth in claim 2 wherein:

the majority of said discrete droplets of the concentrated water base solution of zinc chloride are homogeneously distributed within the solid coating layer and the majority of which are less than 1 micron in diameter.

4. A pressure sensitive chemical type transfer medium as set forth in claim 2 wherein said amine modified wax-like flow agent is selected from the group consisting of the product obtained by reacting a selectively oxidized linear unsaturated hydrocarbon having a terminal carbon double bond with ammonia or a primary organic amine and further reacting the resulting modified hydrocarbon with an isocyanate; the product obtained by reacting an oxidized microcrystalline wax with an isocyanate, the product obtained by reacting an oxidized non-benzenoid wax with an isocyanate; the product obtained by reacting an oxidized microcrystalline wax with ammonia or an amine and further reacting the resulting modified hydrocarbon with an isocyanate and the product obtained by reacting an oxidized non-benzenoid wax with ammonia or an amine and further reacting the resulting modified hydrocarbon with an isocyanate.

5. A pressure sensitive chemical type transfer medium as set forth in claim 1 wherein:

said acidic chloride neutralizing agent is selected from a group consisting of ammonium carbonate and ammonium bicarbonate.

6. A pressure sensitive chemical type transfer medium as set forth in claim 1 wherein said image receptor coating further includes a dispersant and sufficient dry potassium hydroxide to assure an alkaline bias to said receptor layer.

7. A pressure sensitive chemical type transfer medium as set forth in claim 1 wherein:

said image receptor layer comprises the solid residue of an applied alkaline biased liquid intermixture of 50 to 80 parts of an evaporable non-polar liquid hydrocarbon solvent vehicle selected from the group consisting of toluene, acetone, heptane and naphtha; about 7 to 20 parts of said non-acidic resinous binder; opacifier-filler material selected from the group consisting of titanium dioxide and calcium carbonate and about ½ to 5 parts of said chromogenic reagent dispersed therewithin.

8. A pressure sensitive chemical type transfer medium as set forth in claim 1 wherein:

said image receptor layer comprises the solid residue of an applied alkaline biased liquid intermixture of about 53 parts of toluene as a non-polar hydrocarbon solvent, about 13 parts of polyvinylacetate binder material, about 32 parts of opacifier-filler material, about 1 part of potassium hydroxide, about 0.2 parts of a dispersant and about 1 part of chromogenic reagent material dispersed therewithin.

9. A pressure sensitive chemical type transfer medium comprising:

a planar sheet material having at least partially transferable coating layer disposed on one surface thereof;

said transferable coating layer constituted by the solidified residue of an applied hot melt emulsified film consisting of about 35 to 75% of a meltable low oil content hard wax compositely consisting of a major portion of a wax selected from the group consisting of paraffin wax, microcrystalline wax and alpha olefin wax;

at least 1% to about 15% of an amine modified synthetic wax flow agent and dispersant as an emulsifying agent therein;

about 10 to 35% of a concentrated water solution of zinc chloride containing a relatively small amount of an acidic chloride neutralizing agent selected from the group consisting of ammonium carbonate and ammonium bicarbonate and a nontransferable image producing receptor layer disposed on the other surface thereof, said image receptor layer comprising the solid residue of an applied alkaline biased liquid intermixture of 50 to 80 parts of an evaporable non-polar liquid hydrocarbon solvent vehicle selected from the group consisting of toluene, acetone, heptane, and naphtha; about 7 to 20 parts of a non-acidic resinous binder; opacifier-filler material selected from the group consisting of titanium dioxide and calcium carbonate and about ½ to 5 parts of a chromogenic reagent selected from the group consisting of tri (p-phenylamino) phenyl methanol and biphenyl triamino triphenyl methanol.

10. A pressure sensitive chemical type transfer medium as set forth in claim 9 wherein said image receptor layer comprises the solid residue of an applied alkaline biased liquid intermixture of about 53 parts of toluene as a non-polar hydrocarbon solvent, about 13 parts of polyvinylacetate binder material, about 32 parts of opacifier-filler material, about 1 part of potassium hydroxide, about 0.2 parts of a dispersant and about 1 part of chromogenic reagent material dispersed therewithin.

11. A pressure sensitive chemical type transfer medium as set forth in claim 10 wherein said amine modified wax-like flow agent is selected from the group consisting of the product obtained by reacting a selectively oxidized linear unsaturated hydrocarbon having a terminal carbon double bond with ammonia or a primary organic amine and further reacting the resulting modified hydrocarbon with an isocyanate; the product obtained by reacting an oxidized microcrystalline wax with an isocyanate, the product obtained by reacting an oxidized non-benzenoid wax with an isocyanate; the product obtained by reacting an oxidized microcrystalline wax with ammonia or an amine and further reacting the resulting modified hydrocarbon with an isocyanate and the product obtained by reacting an oxidized non-benzenoid wax with ammonia or an amine and further reacting the resulting modified hydrocarbon with an isocyanate.

12. A pressure sensitive chemical type transfer medium comprising:

planar sheet material having an at least partially transferable coating layer disposed on one surface thereof, said transferable coating layer constituted by the solidified residue of an applied hot melt emulsified liquid film consisting of about 50 to 60% of a composite meltable low oil content wax carrier vehicle made up from 3 to 4 parts of paraffin wax to 1 part of carnauba wax;

about 2 to 5% of a synthetic chemically modified wax-like material having the properties of a flow agent and dispersant;

about 3 to 10% of a polyethylenic film forming agent;

about 5% of an opacifier-filler;

about 3 to 10% of stearic acid and about 25 to 35% of a concentrated solution of zinc chloride made up of at least 2 parts of zinc chloride to 1 part of water as an electron accepting chromogenic reagent in emulsified discrete liquid droplet form in said layer together with a relatively small amount of an acid chloride neutralizing agent selected from the group consisting of ammonium carbonate and ammonium bicarbonate and a nontransferable image producing receptor layer disposed on the other surface thereof;

said image receptor layer comprising the solid residue of an applied alkaline biased liquid intermixture of an evaporable non-polar liquid hydrocarbon solvent vehicle, a non-acidic resinous binder, opacifier-filler material and a chromogenic reagent selected from the group consisting of tri (p-phenylamino) phenyl methanol and biphenyl triamino triphenyl methanol dispersed therewithin and being selectively convertable into a color producing condition upon interreaction with said zinc chloride chromogenic reagent material.

13. A pressure sensitive chemical type transfer medium as set forth in claim 12 wherein said image receptor layer comprises the solid residue of an applied alkaline biased liquid intermixture of 50 to 80 parts of an evaporable non-polar liquid hydrocarbon solvent vehicle selected from the group consisting of toluene, acetone, heptane and naptha; about 7 to 20 parts of said non-acidic resinous binder; opacifier-filler material selected from the group consisting of titanium dioxide and calcium carbonate and about ½ to 5 parts of said chromogenic reagent dispersed therewithin.

14. A pressure sensitive chemical type transfer medium as set forth in claim 12 wherein said image receptor layer comprises the solid residue of an applied alkaline biased liquid intermixture of about 53 parts of toluene as a non-polar hydrocarbon solvent, about 13 parts of polyvinylacetate binder material, about 32 parts of opacifier-filler material, about 1 part of potassium hydroxide, about 0.2 parts of a dispersant and about 1 part of chromogenic reagent material dispersed therewithin.

15. A pressure sensitive chemical type transfer medium as set forth in claim 12 wherein said chemically modified wax-like material is selected from the group consisting of the product obtained by reacting a selectively oxidized linear unsaturated hydrocarbon having a terminal carbon double bond with ammonia or a primary organic amine and further reacting the resulting modified hydrocarbon with an isocyanate; the product obtained by reacting an oxidized microcrystalline wax with an isocyanate, the product obtained by reacting an oxidized non-benzenoid wax with an isocyanate; the product obtained by reacting an oxidized microcrystalline wax with ammonia or an amine and further reacting the resulting modified hydrocarbon with an isocyanate and the product obtained by reacting an oxidized non-benzenoid wax with ammonia or an amine and further reacting the resulting modified hydrocarbon with an isocyanate.

* * * * *